United States Patent [19]

Rozzi

[11] 4,380,428

[45] Apr. 19, 1983

[54] SAFETY TIP-OVER DEVICE FOR PORTABLE GAS-FIRED INFRARED RADIANT HEATER

[75] Inventor: Mario Rozzi, St. Clair Shores, Mich.

[73] Assignee: Detroit Radiant Products Company, Detroit, Mich.

[21] Appl. No.: 412,011

[22] Filed: Aug. 26, 1982

Related U.S. Application Data

[63] Continuation of Ser. No. 846,025, Oct. 27, 1977, abandoned.

[51] Int. Cl.[3] ..... F23N 5/24

[52] U.S. Cl. ..... 431/88; 137/38

[58] Field of Search ..... 431/88, 33; 137/38, 137/39

[56] References Cited

U.S. PATENT DOCUMENTS

| | | | |
|---|---|---|---|
| 1,555,649 | 9/1925 | Ferrette | 431/88 |
| 2,318,424 | 5/1943 | Sattler | 137/38 |
| 2,676,708 | 4/1954 | Risk | 137/38 |
| 3,314,411 | 4/1967 | Power | 431/88 |
| 3,349,577 | 10/1967 | Burchett et al. | 431/88 |

*Primary Examiner*—Carroll B. Dority, Jr.

[57] ABSTRACT

The safety tip-over device is adapted for use in connection with a portable gas-fired infrared radiant heater. The system will cause the supply of gas to be substantially discontinued to the heater in the event that the heater is tipped over.

2 Claims, 3 Drawing Figures

SAFETY TIP-OVER DEVICE FOR PORTABLE GAS-FIRED INFRARED RADIANT HEATER

This is a continuation of application Ser. No. 846,025, filed Oct. 27, 1977, now abandoned.

BACKGROUND OF THE INVENTION

In the past, tip-over control devices for portable gas fired infrared heaters have been relatively complicated and expensive structures. Further, such devices have, because of their complexity, required repair and maintenance. Such tip-over devices are desirable in order to avoid spilling unburned gases and to prevent uncontrolled burning which may occur when the heater is not in its proper upright position. The heater, for example, may be tipped over by an animal, a falling object, or as a result of ice or snow melting thereunder when the heater is used outdoors in the winter.

The present invention provides a tip-over control system which will satisfy safety regulations and at the same time is simple in construction, inexpensive to manufacture and install, durable, and effective in operation.

SUMMARY OF THE INVENTION

The safety tip-over device is for a portable gas-fired infrared radiant heater which includes a container for burnable gas under pressure having a burner mounted thereon. The tip-over device comprises an orifice structure mounted on the container for emitting burnable gas into the burner. The orifice structure includes a passageway having a first portion of relatively large diameter and terminating in a restricted portion having an orifice through which the burnable gas is emitted. A foraminous wall in said passageway is provided downstream from the restricted portion. A freely movable valve element is provided in the passageway upstream from the foraminous wall. The valve element is of lesser size than the diameter of the first portion of the passageway to permit free passage of burnable gas when the passageway is angled substantially upwardly. The foraminous wall permits free passage of burnable gas but prevents the valve element from passing thereby. The valve element is of greater size than the orifice to substantially block the orifice to the passage of burnable gas when the passageway is angled substantially horizontally or downwardly.

IN THE DRAWING

Figure 1:
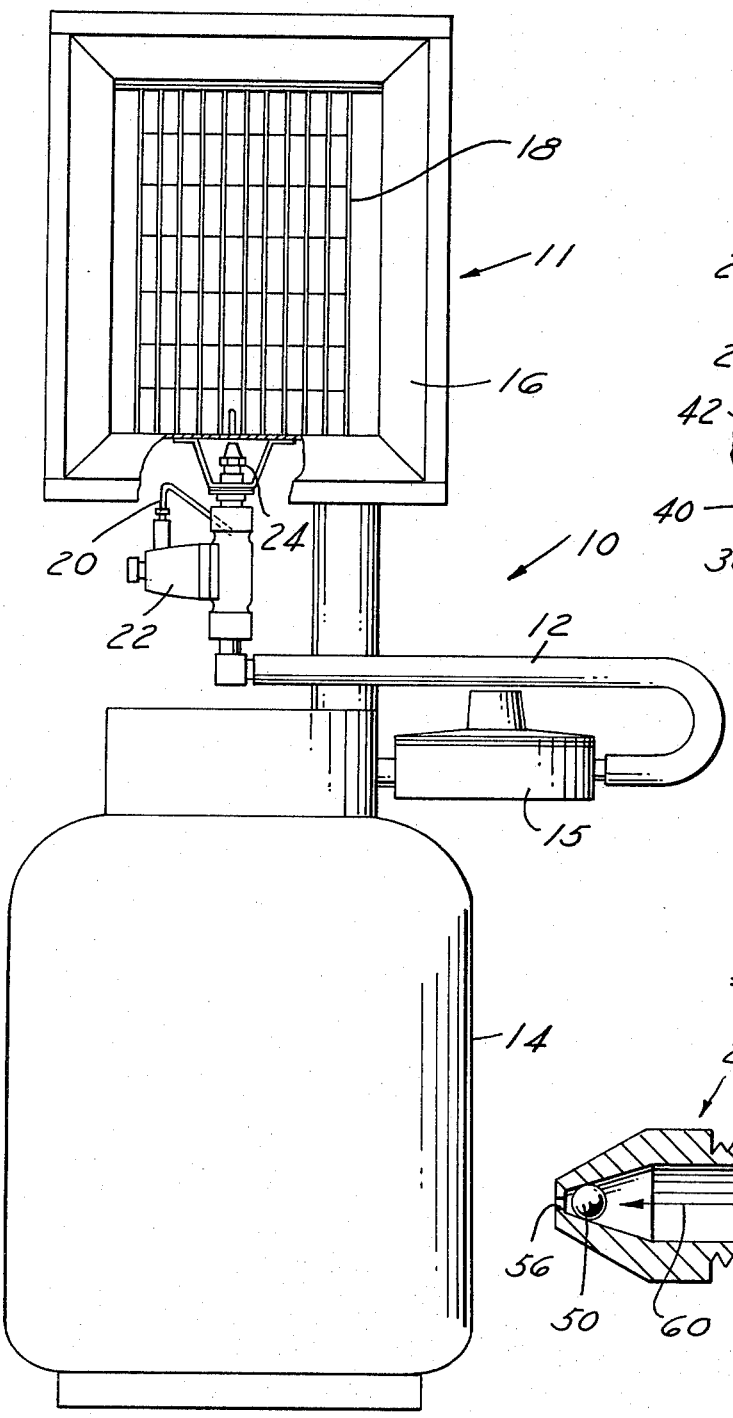
FIG. 1 is an elevational view of the safety tip-over control system for a portable gas-fired infrared radiant heater in accordance with one embodiment of the present invention.
Figure 2:
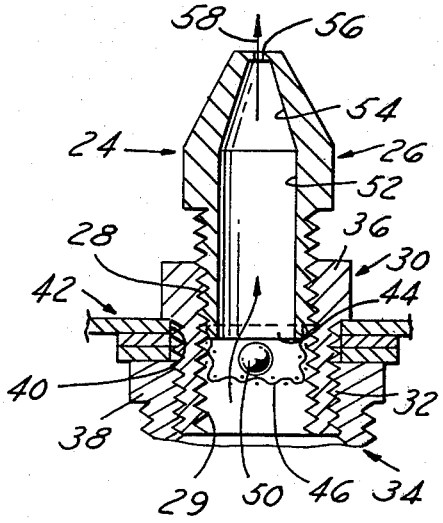
FIG. 2 is a view of the tip-over control device of FIG. 1 in the upright position.

Referring to FIG. 1, it will be noted that a gas-fired portable infrared heater 10 has a burner 11 which is supplied with gas via conduit 12. Conduit 12 is connected to a container 14 which contains burnable gas under pressure. Such gas is usually propane but may be natural gas. Flow of gas through conduit 12 is controlled by valve 15.

The burner 11 comprises a casing 16 which mounts a plurality of ceramic tiles 18 which define a face. The tiles 18 have perforations therethrough and are composed of a material which, when heated to an incandescence, will emit infrared radiation for heating purposes. The tiles may be constructed in accordance with U.S. Pat. No. 2,775,294 issued to Gunther Schwank, or in accordance with other compositions and constructions commercially available on the market. In operation of such tiles, the gas/air mixture which is formed in casing 16 behind the tiles, flows through the tile perforations and burns as it leaves the holes. The burning takes effect at the surface of the tiles, thus heating the tiles to incandescence. Air is introduced into casing 16 along with the gas.

A flame sensor 20 and associated structure 22 is provided to discontinue flow of gas to the burner after the flame is extinguished.

The tip-over device 24 includes an orifice structure 26 positioned at the inlet of the burner 11 through which burnable gas flows into the combustion chamber from container 14 via conduit 12. The orifice structure 26 is externally threaded at 28 for threading reception in internal threads 29 of fitting 30.

The fitting 30 is also externally threaded at 32 for threading reception in a second internally threaded fitting 34. Each of the fittings has a wrench engageable head 36, 38. When the fittings are threaded together through opening 40 in bracket structure 42, heads 36, 38 press against the bracket structure to secure the assembly in place.

An unthreaded portion 44 of reduced diameter is provided at the inner end of orifice structure 26 adjacent the threaded portion 28. A cup-shaped element 46 fabricated of foraminous material is received in fitting 30 immediately below the orifice structure 26. The upper marginal edge portion of element 46 is received over unthreaded portion 44 and is held in place by the clamping action of fitting threads 29. A small steel ball 50 normally rests on the element 46 with the heater in the upright position as shown in FIG. 1. The element 46 retains the ball in orifice structure 26 while at the same time permitting gas to flow thereby.

The orifice structure 26 includes a cylindrical central passageway 52 terminating in a cone-shaped restriction 54. A small orifice 56 is provided in the end for gas to pass through as a jet, as represented by arrow 58. The ball 50 is of greater diameter than the orifice 56 and of less diameter than passageway 52 and the major portion of restriction 54.

Figure 3:
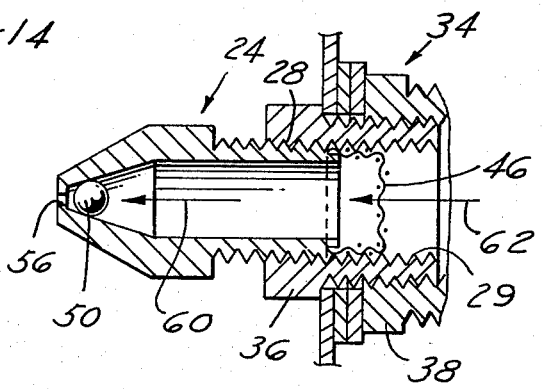
FIG. 3 is a view of the tip-over control device after the heater has been tipped over.

If the heater 10 is tipped over while the burner 11 is lit, the ball, as shown in FIG. 3, is driven into restriction 54 by the gas under pressure as illustrated by arrows 60, 62. The usual gas pressure in such heaters is, for example, in the range of about eleven inches of water (somewhat less than one pound). In this position, the ball 50 blocks orifice 56 sufficiently to cause the flame in burner 11 to be extinguished After a short time, as for example 30 seconds, the flame sensor 20 will cause the gas supply to be completely terminated. It has been found that the gas pressure is effective to drive the ball 50 into blocking position whenever the orifice structure 24 is close to horizontal (within about 2°) or is pointed downwardly. There is usually some slight leakage of gas by the ball but such leakage is insufficient to maintain combustion in the burner.

It will, of course, be appreciated that the safety tip-over device may be separate from the orifice structure 26 and be located downstream thereof. However, the most economical structure is to incorporate the two structures together as shown.

What I claim as my invention is:

1. A safety tip-over device for a portable gas-fired radiant heater including a container for burnable gas under pressure having a burner mounted thereon, said device comprising an orifice structure mounted on the container for emitting burnable gas into the burner, said orifice structure including a passageway having a first portion of relatively large diameter and terminating in a restricted portion having an orifice through which said burnable gas is emitted, a foraminous wall in said passageway upstream from said restricted portion, a freely movable valve element in said passageway downstream from said foraminous wall, said valve element being of lesser size than the diameter of said first portion of the passageway to permit free passage of burnable gas when the passageway is angled substantially upwardly, said foraminous wall permitting free passage of burnable gas but preventing said valve element from passing thereby, said valve element being of greater size than said orifice and reactive to the pressure of burnable gas flowing through the orifice structure to move into blocking position with respect to said orifice when the passageway is angled horizontally or slightly upwardly.

2. A safety tip-over device as defined in claim 1, further characterized in that said valve element is effective to block the orifice when the passageway is angled upwardly by about 2 degrees with respect to the horizontal plane.

* * * * *